United States Patent [19]

Stubbs et al.

[11] 3,964,282

[45] June 22, 1976

[54] ROLLING MILLS

[75] Inventors: Dennis Stubbs; Jack Maltby, both of Sheffield; Roy Ronald Oxlade, London, all of England

[73] Assignees: British Steel Corporation; The British Iron and Steel Research Association, both of London, England

[22] Filed: Dec. 12, 1975

[21] Appl. No.: 640,154

Related U.S. Application Data

[63] Continuation of Ser. No. 511,375, Oct. 2, 1974, abandoned, Continuation of Ser. No. 358,843, May 10, 1973, abandoned.

[30] Foreign Application Priority Data

May 19, 1972 United Kingdom ..... 23715/72

[52] U.S. Cl. ..... 72/19; 72/237

[51] Int. Cl.[2] ..... B21B 37/06

[58] Field of Search ..... 72/9, 10, 12, 19, 20, 72/205, 21, 238, 237

[56] References Cited

UNITED STATES PATENTS

| | | | |
|---|---|---|---|
| 3,018,676 | 1/1962 | Polakowski | 72/21 |
| 3,177,346 | 4/1965 | Green | 72/8 X |
| 3,208,251 | 9/1965 | Hulls et al. | 72/11 |
| 3,587,267 | 6/1971 | Townsend et al. | 72/21 |
| 3,733,875 | 5/1973 | Steimer | 72/21 X |
| 3,818,742 | 6/1974 | Maltby et al. | 72/238 |
| 3,861,190 | 1/1975 | Maltby et al. | 72/247 |

*Primary Examiner*—Milton S. Mehr
*Attorney, Agent, or Firm*—Bacon & Thomas

[57] ABSTRACT

A rolling mill stand having work rolls and back-up rolls extending from respective arms which are pivotally mounted, and including a pair of load cells recessed into one side of each work roll arm and a loading device recessed into the opposite side of each work roll arm. The load cells are spaced at different distances from the stock pass line, and the loading device is disposed on the centre line passing between the load cells. The arrangement is used for tension measurement in the rolled stock and minimizes errors arising from twisting of the work roll arms.

10 Claims, 5 Drawing Figures

ROLLING MILLS

This application is continuation of application Ser. No. 511,375, filed Oct. 2, 1974, abandoned, which is a continuation of application Ser. No. 358,843, filed May 10, 1973 and now abandoned.

A rolling mill stand including an arrangement for measuring the tension adjacent to the stand in stock being rolled is described in British patent specification 1,240,657 (P.530). The present invention relates to an improved mill stand.

According to the present invention there is provided a rolling mill stand having a frame and two work rolls carried for rotation in arms mounted for pivotal movement relative to one another in said frame whereby to vary the roll gap, at least one of said work roll arms being movable to a limited extent in the direction of the stock pass line and wherein two load sensing devices are disposed between said one work roll arm and the frame, one load sensing device being closer to the stock pass line than the other, said devices providing in use signals embodying a measure of the tension in the stock adjacent said mill stand.

By providing two load sensing devices the average of the signals can be taken and hence any errors due to twisting of the work roll arm can be minimised.

Preferably the mill stand is a four high stand and includes support rolls bearing on the work rolls, the support rolls being mounted on support roll arms pivoted for movement relative to one another, the load sensing devices being provided between said one work roll arm and the support corresponding roll arm. Preferably the load sensing devices are disposed in recesses within bearing blocks forming part of said one work roll arm. The bearing block is preferably disposed between two side cheeks projecting from a chock forming part of said support roll arm, and preferably the work roll arms form a sub-assembly removable from the support roll arms. By having the load sensing devices disposed in recesses in the bearing block, the sub-assembly of the work roll arm is rendered easily removable from the support roll arms.

Preferably means are provided for preloading the load sensing devices and this can be achieved by having self loading load sensing devices, but is preferably achieved by having a loading device disposed on the opposite side of said one work roll arm from the load sensing devices on the centre line passing between said load sensing devices whereby to urge the work roll arm to apply an equal load to said load sensing devices. Preferably the loading device is disposed in a recess within said bearing block.

Figure 1:
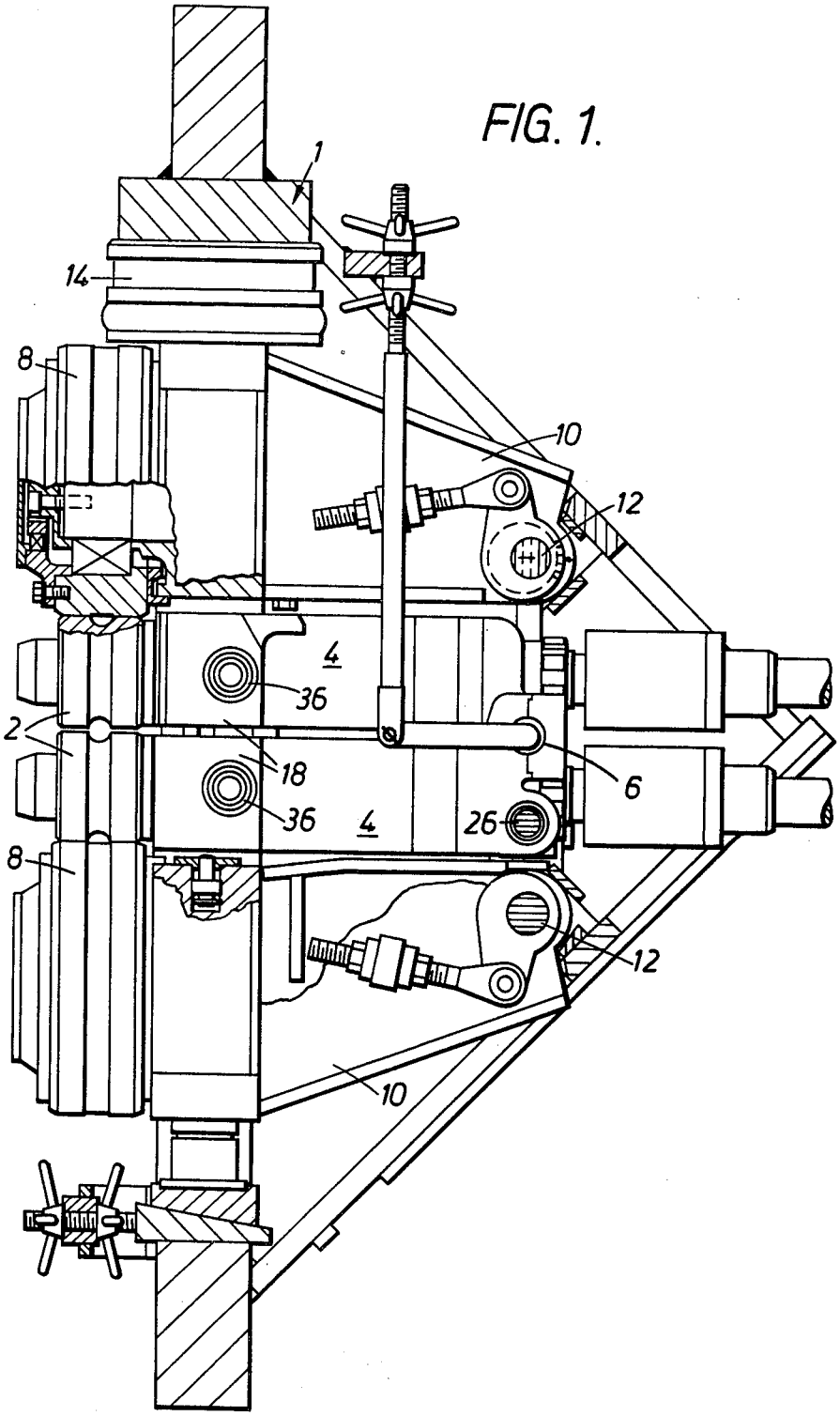
Figure 2:
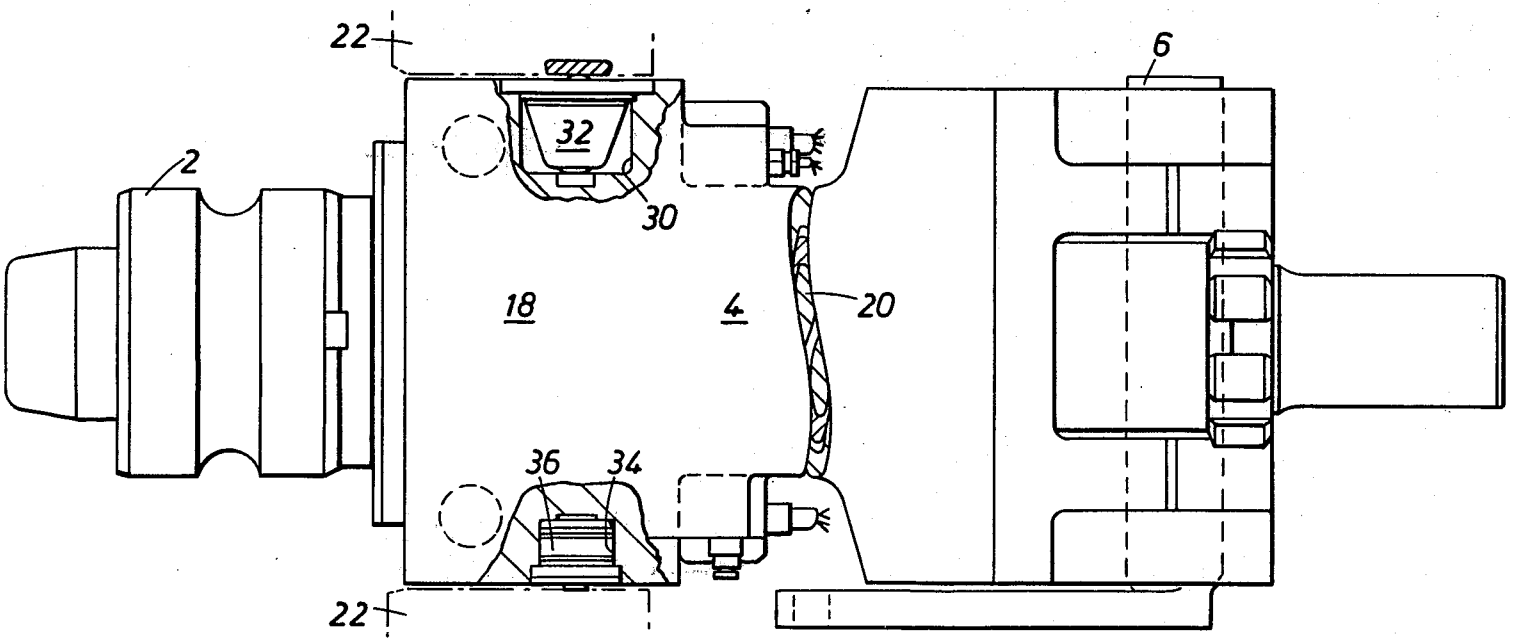
Figure 3:
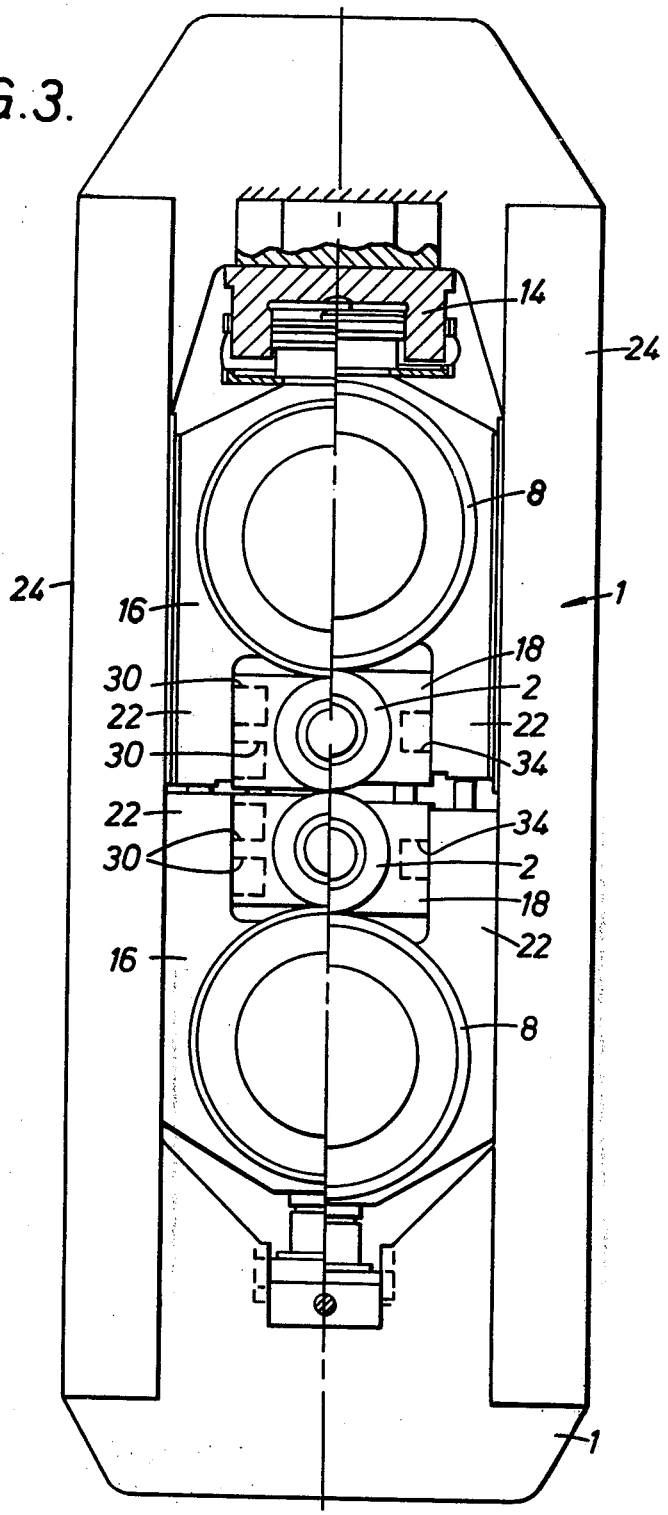
Figure 4:
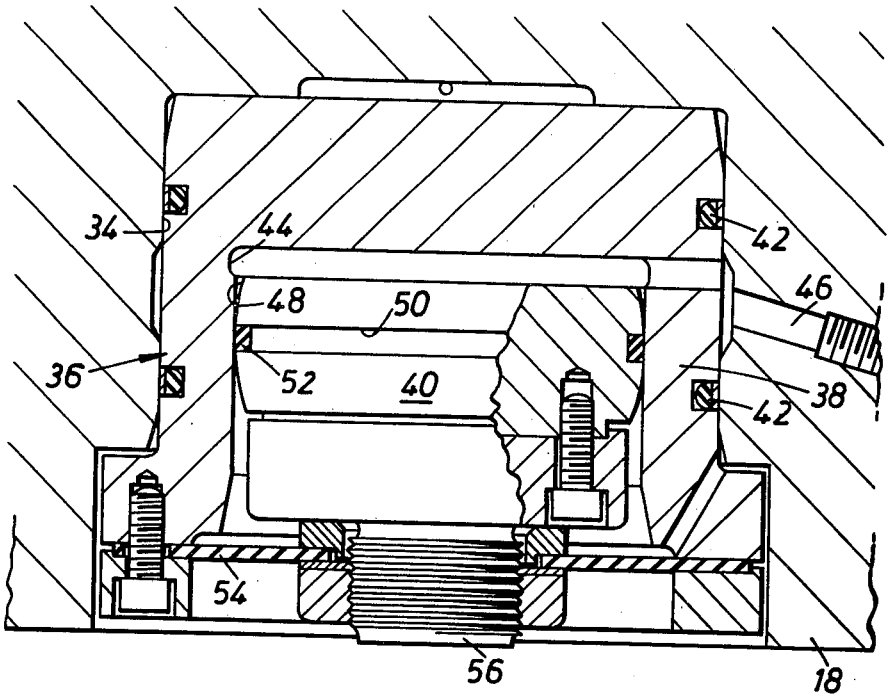
Figure 5:
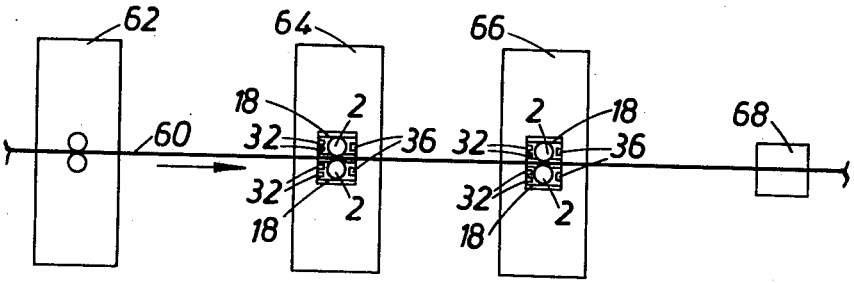

One embodiment of the invention will not be described, by way of example only, with reference to the accompanying drawings in which:

FIG. 1 is a part sectional side elevation of one stand of a close coupled twin stand four high rolling mill, FIG. 2 is a top plan view of the sub-assembly of the two work roll arms, FIG. 3 is a part sectional front elevation of the stand shown in two positions to either side of the vertical centre line, FIG. 4 is a sectional view of a loading device, and FIG. 5 is a diagrammatic view of a mill train.

The rolling mill stand has a frame 1 and two work rolls carried for rotation in arms 4 which are mounted for pivotal movement in the frame 1 relative to one another about pivot pin 6 whereby the roll gap can be varied. The arms 4 include bearing blocks 18 surrounding drive shafts 20. Support rolls 8 bear on the work rolls 2, the support rolls 8 being mounted on support roll arms 10 mounted for pivotal movement in the frame 1 about individual spaced apart pivots 12. The arms 10 include massive forward chocks 16 each of which has two projecting side cheeks 22 closely fitting within frame standards 24. The bearing blocks 18 fit between the side cheeks 22 as can best be seen in FIG. 3. The work roll arms 4 form a sub-assembly removable from the support roll arms 10 and frame 1 upon removal of a latch pin 26. An actuator 14 bears on the upper chock 16 to apply a load between the work rolls 2. Further details of the mill are described in our copending U.K. Patent Applications 3887/72 (P.7210) and 3888/72 (P.7211, now U.S. Pat. Nos. 3,861,190 and 3,818,742 respectively.

As can be seen in FIG. 2 the bearing blocks 18 of the work roll arms 4 are movable to a limited extent between the side cheeks 22 of the chocks 16 in the direction of the stock pass line. This movement is allowed for by slight play provided by the latch pin 26.

There are two recesses 30 in each bearing block 18 adjacent to one side cheek 22. The recesses 30 house load sensing devices or load cells 32. There is another recess 34 in each bearing block 18 on the opposite side from the recesses 30 which houses a loading device 36. The load cells 32 in one block 18 are equally spaced on either side of a line passing through the axis of the associated work roll 2 and parallel to the stock pass line so that one cell 32 is closer to the stock pass line then the other. Since the bearing blocks 18 are rectangular as seen in FIG. 3 the load cells 32 are conveniently located in the corners of the block 18 away from the hole in the block 18 for the shaft 20. The loading device lies on the centre line passing between the load cells 32 so that the loading device 36 urges the work roll arms 4 to apply an equal load to the two cells 32. The load cells 32 shown in FIG. 2 are of a conventional type and need no further description. By having the load cells 32 and loading device 36 housed in recesses in the block 18 they are conveniently removed from the frame for access when the sub-assembly of the work roll arms 4 is removed from the frame.

The loading device 36, as shown in detail in FIG. 4, consists of a cylinder 38 and a piston 40. The cylinder 38 makes a close fit in the recess 34 and is held in the recess 34 by the friction of O rings 42. The bore of the cylinder 38 has a recess 44 at its closed end communicating with a hydraulic fluid inlet 46. The piston 40 has a part spherical surface 48 forming a close fit within the bore of the cylinder 38. A groove 40 is formed in the spherical surface 48 and houses a sealing ring 52 of low friction material. Th interior of the cylinder 38 is sealed against dirt by a flexible diaphragm 54. In use hydraulic fluid under pressure introduced through inlet 46 displaces the piston 40 so that the outer surface 56 of a projection on the piston bears against the side cheek 22 of the chock 16 so as to load the load cells 32. The spherical surface 48 of the piston allows slight inclination of the axis of the piston 40 with the axis of the cylinder 38.

FIG. 5 shows steel rod or bar stock 60 moving from left to right and being rolled through the three last stands 62, 64, 66 of a rolling mill train. The stock 60 then passes to a shear 68 where lengths of rolled stock are cut to length. The two last stands 64, 66 are of the kind shown in FIGS. 1 to 4 and have load cells 32 on their left hand sides and loading devices 36 on their right hand sides. By appropriately preloading the loading devices 36 the load cells 32 can give an indication of tension or compression in the stock between the stands 64 and 66 (called the interstand tension) and an indication of the tension or compression in the stock between the stands 62 and 64 (called the back tension). Any tension between stands 62 and 64 causes a deflection of the blocks 18 and will be registered by a signal from the cells 32 of stand 64. If a bearing block 18 tilts slightly between the cheeks 22 of the chock 16 one cell 32 will give a different signal from the other but an average of the two signals will represent the deflection of the block. Averaging of the four signals from the four load cells on the stand 64 will eliminate errors due to one chock 18 displacing more than the other. Similarly the cells 32 on stand 66 will give an indication of the interstand tension between stand 64 and 66. Any compression in the stock between stands 62 and 64 will be indicated by signals from cells 32 on stand 64 so long as the preload provided by the loading device 36 is sufficient to ensure that the cells 32 are loaded. This can be arranged so that any compression likely to occur in practice will not unload the cells 32. Similarly the preloading of the loading device 36 on stand 66 can be arranged so that any compression in the stock between the stands 64 and 66 will be indicated by the cells 32 on stand 66. Signals indicating the interstand tension and back tension can be used to control the speed or roll gap of the stand 64, 66 to ensure that stock of the desired dimensions is discharged from stand 66.

We claim:

1. A rolling mill stand, comprising: a frame, a sub-assembly removable from said frame comprising two driveable work rolls, two work roll arms carrying said work rolls, and means for pivotally mounting the two work roll arms so that they are pivotally movable relative to one another to permit adjustment of the work roll gap, at least one of said work roll arms being movable to a limited extent in the direction of the stock pass line, and latch means independent of the pivotal mounting means extending between the mill frame and the sub-assembly for releasably holding the sub-assembly to the frame, two support rolls rotatably carried in said frame and bearing upon said work rolls, said support rolls being mounted on arms pivoted for movement relative to one another, two load sensing devices disposed between said one work roll arm and their associated support roll arm and on the upstream side of said one work roll arm, one load sensing device being closer to the stock pass line than the other, said devices providing in use signals embodying a measure of the tension in the stock adjacent said mill stand, and a hydraulic loading device disposed on the opposite side of said one work roll arm from the load sensing devices and on the center line passing between said load sensing devices engageable with said work roll arm for urging said one work roll arm in the upstream direction to apply an equal load to each of said load sensing devices.

2. A mill stand according to claim 1 in which said loading device is disposed in a recess within a bearing block forming part of said one work roll arm.

3. A mill stand according to claim 2 in which said bearing block is disposed between two side cheeks projecting from a chock forming part of said associated support roll arm.

4. A mill stand according to claim 1 in which the load sensing devices are disposed in recesses within a bearing block forming part of said one work roll arm.

5. A mill stand according to claim 4 in which said bearing block is disposed between two side cheeks projecting from a chock forming part of said associated support roll arm.

6. A rolling mill stand, comprising: a frame, a sub-assembly removable from said frame comprising two driveable work rolls, two work roll arms carrying said work rolls, and means for pivotally mounting the two work roll arms so that they are pivotally movable relative to one another to permit adjustment of the work roll gap, at least one of said work roll arms being movable to a limited extent in the direction of the stock pass line, latch means independent of the pivotal mounting means extending between the mill frame and the sub-assembly for releasably holding the sub-assembly to the frame, two support rolls bearing upon the work rolls, said support rolls being mounted on support roll arms pivoted about separate spaced pivot axes for movement relative to one another, two load sensing devices disposed between said one work roll arm and their associated support roll arm, one load sensing device being closer to the stock pass line than the other, said load sensing devices providing in use signals embodying a measure of the tension in the stock adjacent said mill stand; and a hydraulic loading device disposed on the opposite side of said one work roll arm from the load sensing devices between said one work roll arm and its associated support roll arm and on the center line passing between said load sensing devices engageable with said work roll arm for urging said work roll arm to apply an equal load to each of said load sensing devices, said loading device being disposed in a recess within a bearing block forming part of said one work roll arm, said bearing block being disposed between two side cheeks projecting from a chock forming part of said associated support roll arm.

7. A rolling mill stand according to claim 6 in which the load sensing devices are disposed in recesses in said bearing block whereby said hydraulic loading device and said load sensing devices are removed from said frame upon removal of said sub-assembly from said frame.

8. A mill stand according to claim 6 in which said hydraulic loading device comprises a piston slidably mounted in a cylinder located within said bearing block, said cylinder having passage means connecting the head of said piston with the exterior of said bearing block for furnishing hydraulic fluid under pressure to said cylinder to actuate said piston and hydraulically load said load sensing devices.

9. In a rolling mill stand having a frame, a sub-assembly removable from said frame comprising two driveable work rolls, two work roll arms carrying said work rolls, and means for pivotally mounting the two work roll arms so that they are pivotally movable relative to one another to permit adjustment of the work roll gap, at least one of said work roll arms being movable to a limited extend in the direction of the stock pass line, latch means independent of the pivotal mounting means, extending between the mill frame and the sub-assembly for releasably holding the sub-assembly to the frame, two support rolls bearing upon the work rolls, said support rolls being mounted on support roll arms pivoted about separate spaced pivot axes for movement relative to one another, a bearing block forming part of said one work roll arm disposed between two side cheeks projecting from a chock forming part of the support roll arm associated with said one work roll arm, the improvement comprising: two load sensing devices disposed in recesses in one side of said bearing block and engageable with the associated side cheek, one load sensing device being closer to the stock pass line than the other, said load sensing devices providing in use signals embodying a measure of the tension in the stock adjacent said mill stand; and a hydraulic loading device disposed in a recess on the opposite side of said bearing block from the load sensing devices and located on the center line passing between said load sensing devices, said loading device being positioned for engagement with the associated side cheek for urging said one work roll arm to apply an equal load to each of said load sensing devices.

10. A mill stand according to claim 9 in which said hydraulic loading device comprises a piston slidably mounted in a cylinder located within said bearing block, said cylinder having passage means connecting the head of said piston with the exterior of said bearing block for furnishing hydraulic fluid under pressure to said cylinder to actuate said piston and hydraulically load said load sensing devices.

* * * * *